US007556597B2

(12) United States Patent
Miller, III et al.

(10) Patent No.: US 7,556,597 B2
(45) Date of Patent: Jul. 7, 2009

(54) ACTIVE VIBRATION ATTENUATION FOR IMPLANTABLE MICROPHONE

(75) Inventors: Scott Allan Miller, III, Lafayette, CO (US); Bernd Waldmann, Boulder, CO (US); David L. Basinger, Loveland, CO (US)

(73) Assignee: Otologics, LLC, Boulder, CO (US)

( * ) Notice: Subject to any disclaimer, the term of this patent is extended or adjusted under 35 U.S.C. 154(b) by 893 days.

(21) Appl. No.: 10/982,639

(22) Filed: Nov. 5, 2004

(65) Prior Publication Data

US 2005/0101831 A1 May 12, 2005

Related U.S. Application Data

(60) Provisional application No. 60/518,537, filed on Nov. 7, 2003.

(51) Int. Cl.
*H04R 25/00* (2006.01)

(52) U.S. Cl. ..... 600/25

(58) Field of Classification Search ..... 600/25; 381/322, 71.7, 71.6, 71.1, 23.1, 312–321, 381/324

See application file for complete search history.

(56) References Cited

U.S. PATENT DOCUMENTS

| | | | | |
|---|---|---|---|---|
| 4,442,323 | A * | 4/1984 | Yoshida et al. | 381/113 |
| 4,443,666 | A | 4/1984 | Cote | 318/113 |
| 4,450,930 | A | 5/1984 | Killion | 181/129 |
| 4,504,703 | A | 3/1985 | Schneiter et al. | 181/163 |
| 4,532,930 | A | 8/1985 | Crosby et al. | 128/419 |
| 4,606,329 | A | 8/1986 | Hough | 128/1 |
| 4,607,383 | A | 8/1986 | Ingalls | 381/113 |
| 4,621,171 | A | 11/1986 | Wada et al. | 381/113 |
| 4,774,933 | A | 10/1988 | Hough et al. | 600/25 |
| 4,815,560 | A | 3/1989 | Madaffari | 181/129 |
| 4,837,833 | A | 6/1989 | Madaffari | 181/129 |
| RE33,170 | E | 2/1990 | Byers | 128/419 |
| 4,932,405 | A | 6/1990 | Peeters et al. | 128/419 |
| 4,936,305 | A | 6/1990 | Ashtiani et al. | 128/420.6 |
| 5,015,224 | A | 5/1991 | Maniglia | 600/25 |
| 5,105,811 | A | 4/1992 | Kuzma | 128/420.6 |
| 5,163,957 | A | 11/1992 | Sade et al. | 623/10 |
| 5,176,620 | A | 1/1993 | Gilman | 600/25 |
| 5,219,037 | A * | 6/1993 | Smith et al. | 180/312 |
| 5,277,694 | A | 1/1994 | Leysieffer et al. | 600/25 |
| 5,363,452 | A | 11/1994 | Anderson | 381/170 |
| 5,402,496 | A | 3/1995 | Soli | 381/94.2 |
| 5,411,467 | A | 5/1995 | Hortmann et al. | 600/25 |

(Continued)

*Primary Examiner*—Samuel G Gilbert
(74) *Attorney, Agent, or Firm*—Marsh Fischmann & Breyfogle LLP

(57) ABSTRACT

The invention is directed to an implanted microphone having reduced sensitivity to vibration. In this regard, the microphone differentiates between the desirable and undesirable vibration by utilizing at least one motion sensor to produce a motion signal when an implanted microphone is in motion. This motion signal is used to yield a microphone output signal that is less vibration sensitive. In a first arrangement, the motion signal may be processed with an output of the implantable microphone transducer to provide an audio signal that is less vibration-sensitive than the microphone output alone. In another arrangement, the motion signal may be utilized to actuate at least one actuator. Such an actuator may be capable of applying a force to move the implantable microphone or an implant capsule so as to reduce movement of a microphone diaphragm relative to the skin of a patient which covers the microphone diaphragm.

18 Claims, 2 Drawing Sheets

U.S. PATENT DOCUMENTS 5,456,654 A 10/1995 Ball ..... 600/25
5,475,759 A 12/1995 Engelbreston ..... 381/318
5,500,902 A 3/1996 Stockham, Jr. et al. ..... 381/320
5,554,096 A 9/1996 Ball ..... 600/25
5,558,618 A 9/1996 Maniglia ..... 600/25
5,624,376 A 4/1997 Ball et al. ..... 600/25
5,647,579 A * 7/1997 Satoh ..... 267/140.14
5,680,467 A 10/1997 Hansen ..... 381/314
5,702,431 A 12/1997 Wang et al. ..... 607/61
5,749,912 A 5/1998 Zhang et al. ..... 607/57
5,762,583 A 6/1998 Adams et al. ..... 600/25
5,795,287 A 8/1998 Ball et al. ..... 600/25
5,800,336 A 9/1998 Ball et al. ..... 600/25
5,814,095 A 9/1998 Muller et al. ..... 607/57
5,842,967 A 12/1998 Kroll ..... 600/25
5,848,171 A 12/1998 Stockham, Jr. et al. ..... 381/310
5,857,958 A 1/1999 Ball et al. ..... 600/25
5,859,916 A 1/1999 Ball et al. ..... 381/326
5,881,158 A 3/1999 Lesinski et al. ..... 381/174
5,888,187 A 3/1999 Jaeger et al. ..... 600/25
5,897,486 A 4/1999 Ball et al. ..... 600/25
5,906,635 A 5/1999 Maniglia ..... 607/57
5,912,977 A 6/1999 Gottschalk-Schoenig ... 381/321
5,913,815 A 6/1999 Ball et al. ..... 600/25
5,951,601 A 9/1999 Lesinski et al. ..... 623/10
6,044,162 A 3/2000 Mead et al. ..... 381/312
6,072,884 A 6/2000 Kates ..... 381/318
6,072,885 A 6/2000 Stockham, Jr. et al. ..... 381/321
6,093,144 A * 7/2000 Jaeger et al. ..... 600/25
6,097,823 A 8/2000 Kuo ..... 381/312
6,104,822 A 8/2000 Melanson et al. ..... 381/320
6,108,431 A 8/2000 Bachler ..... 381/312
6,128,392 A 10/2000 Leysieffer et al. ..... 381/318
6,134,329 A 10/2000 Gao et al. ..... 381/60
6,151,400 A 11/2000 Seligman ..... 318/317
6,163,287 A 12/2000 Huang ..... 341/143
6,173,063 B1 1/2001 Melanson ..... 381/318
6,198,971 B1 3/2001 Leysieffer ..... 607/55
6,381,336 B1 4/2002 Lesinski et al. ..... 381/326
6,422,991 B1 7/2002 Jaeger ..... 600/25
6,626,822 B1 9/2003 Jaeger ..... 600/25
6,707,920 B2 3/2004 Miller ..... 381/326
6,807,445 B2 10/2004 Baumann ..... 607/57

* cited by examiner

ACTIVE VIBRATION ATTENUATION FOR IMPLANTABLE MICROPHONE

CROSS REFERENCE TO RELATED APPLICATIONS

This application claims priority under 35 U.S.C. 119 to U.S. Provisional Application No. 60/518,537 entitled: "Active Vibration Attenuation for Implantable Microphone," having a filing date of Nov. 7, 2003; the contents of which are incorporated herein as if set forth in full.

FIELD OF THE INVENTION

The present invention relates to implanted microphone assemblies, e.g., as employed in implantable hearing instruments, and more particularly, to implanted microphone assemblies having reduced sensitivity to vibration.

BACKGROUND OF THE INVENTION

In the class of hearing aid systems generally referred to as implantable hearing instruments, some or all of various hearing augmentation componentry is positioned subcutaneously on, within, or proximate to a patient's skull, typically at locations proximate the mastoid process. In this regard, implantable hearing instruments may be generally divided into two sub-classes, namely semi-implantable and fully implantable. In a semi-implantable hearing instrument, one or more components such as a microphone, signal processor, and transmitter may be externally located to receive, process, and inductively transmit an audio signal to implanted components such as a transducer. In a fully implantable hearing instrument, typically all of the components, e.g., the microphone, signal processor, and transducer, are located subcutaneously. In either arrangement, an implantable transducer is utilized to stimulate a component of the patient's auditory system (e.g., ossicles and/or the cochlea).

By way of example, one type of implantable transducer includes an electromechanical transducer having a magnetic coil that drives a vibratory actuator. The actuator is positioned to interface with and stimulate the ossicular chain of the patient via physical engagement. (See e.g., U.S. Pat. No. 5,702,342). In this regard, one or more bones of the ossicular chain are made to mechanically vibrate, which causes the ossicular chain to stimulate the cochlea through its natural input, the so-called oval window.

As may be appreciated, hearing instruments that propose utilizing an implanted microphone will require that the microphone be positioned at a location that facilitates the receipt of acoustic signals. For such purposes, an implantable microphone may be positioned (e.g., in a surgical procedure) between a patient's skull and skin, for example, at a location rearward and upward of a patient's ear (e.g., in the mastoid region).

For a wearer a hearing instrument including an implanted microphone (e.g., middle ear transducer or cochlear implant stimulation systems), the skin and tissue covering the microphone diaphragm may increase the vibration sensitivity of the instrument to the point where body sounds and the wearer's own voice, conveyed via bone conduction, may saturate internal amplifier stages and thus lead to distortion. Also, in systems employing a middle ear stimulation transducer, the system may produce feedback by picking up and amplifying vibration caused by the stimulation transducer.

Certain proposed methods intended to mitigate vibration sensitivity may potentially also have an undesired effect on sensitivity to airborne sound as conducted through the skin. It is therefore desirable to have a means of reducing system response to vibration, without affecting sound sensitivity. This is the goal of the present invention.

SUMMARY OF THE INVENTION

In order to achieve this goal, it is necessary to differentiate between the desirable case, caused by outside sound, of the skin moving relative to an (stationary) implant housing, and the undesirable case, caused by bone vibration, of an implant housing moving relative to the (stationary) skin, which will result in the inertia of the skin exerting a force on the microphone diaphragm.

According to a primary aspect of the invention, differentiation between the desirable and undesirable cases is achieved by utilizing at least one motion sensor to produce a signal when an implanted microphone is in motion (e.g., relative to an intertial mass). Such a sensor may be, without limitation, an acceleration sensor and/or a velocity sensor. In any case, the signal is indicative movement of the implanted microphone diaphragm. In turn, this signal is used to yield a microphone output signal that is less vibration sensitive.

The motion sensor(s) may be interconnected to an implantable support member for co-movement therewith. For example, such support member may be a part of an implantable microphone or part of an implantable capsule to which the implantable microphone is mounted.

In the first arrangement, the implantable microphone may comprise a microphone housing, an external diaphragm disposed across an aperture of the housing, and a microphone transducer interconnected to the microphone housing and operable to provide an output signal responsive to movement of the diaphragm. Such output signal may be supplied to an implantable stimulation transducer for middle ear, inner ear and/or cochlear implant stimulation. In this arrangement, the motion sensor(s) may be interconnected to the microphone housing and/or the microphone transducer for co-movement therewith. An example of a middle ear stimulation transducer arrangement is described in U.S. Pat. No. 6,491,622, hereby incorporated by reference.

In the second arrangement, the implanted microphone may be supportably interconnected within an opening of an implant capsule, wherein the external diaphragm is located to receive incident acoustic waves and a microphone transducer is hermetically sealed within the implant capsule. In this arrangement, the motion sensor(s) may be interconnected to the implant capsule for co-movement therewith. Such implant capsule may also hermetically house other componentry (e.g., processor and/or circuit componentry, a rechargeable energy source and storage device, etc.) and may provide one or more signal terminal(s) for electrical interconnection (e.g., via one or more cables) with an implantable stimulation transducer for middle ear or cochlear implant stimulation.

In either arrangement, the motion sensor(s) may be positioned such that an axis of sensitivity of the sensor is aligned with a principal direction of movement of the microphone diaphragm. Such a principal direction of movement may be substantially normal to a surface (e.g., a planar surface) defined by the diaphragm. Such alignment of the motion sensor may allow for enhanced detection of undesired movement between the diaphragm and overlying tissue (e.g., skin). More preferably, such an axis of sensitivity may extend through the center of mass of the microphone. This may allow for more accurately identifying movement of the microphone as an assembly. Accordingly, the center of mass of the microphone assembly and motion sensor(s) may be located on a common axis that may also be directed normal to the principal direction of movement of the microphone diaphragm. In an arrangement where a plurality of motion sensor(s) are employed, the sensors may be positioned so that their centroid or combinative center of mass is located on such a common axis.

In another aspect utilizing a motion sensor to yield a microphone output signal that is less vibration sensitive, the output of the motion sensor may be processed with an output of the implantable microphone transducer to provide an audio signal that is less vibration-sensitive than the microphone output alone. For example, the motion sensor output may be appropriately scaled, phase shifted and/or frequency-shaped to match a difference in frequency response between the motion sensor output and the microphone transducer output, then subtracted from the microphone transducer output to yield a net, improved audio signal employable for driving a middle ear transducer, an inner ear transducer and/or a cochlear implant stimulation system.

In a yet further aspect of the invention, the motion sensor output may be utilized by a controller to provide a control output to at least one actuator. Such an actuator may be capable of moving an implantable microphone assembly housing or an implant capsule (e.g., relative to a vibrational source), so as to substantially reduce movement of the microphone diaphragm relative to the skin of a patient which covers the microphone diaphragm. By way of example only, a piezoelectric, electromagnetic, or acoustic actuator(s) may be employed.

As noted, in certain arrangements the motion sensor(s) may be interconnected to a part of an implantable microphone for co-movement therewith. In such arrangements, the actuator(s) may be interconnected to an implant capsule and actuatable to apply forces to the microphone (e.g., the microphone housing) so as to reduce undesired movement of the external diaphragm. In such arrangements, a compliant member may be interposed between the microphone assembly and that portion of the implant capsule to which the actuator(s) is interconnected. As further noted above, in certain arrangements the motion sensor(s) may be interconnected to an implant capsule. In turn the motion sensor(s) may be interconnected to a proof mass, i.e., a reference mass for the motion sensor(s). In such arrangements, the actuator(s) may be interconnected to the microphone (e.g., the microphone housing) and actuatable to apply forces against the implant capsule and/or the motion sensor (e.g., a proof mass of the sensor) to reduce undesired movement of the external diaphragm. Further, a compliant member may be interposed between the implant capsule and a patient's skull or other anatomical structure upon implantation, allowing forces of the actuator to move the implant capsule relative to the skull or other anatomical structure.

Preferably, in each of the noted arrangements utilizing an actuator(s), the actuator(s) may be desirably positioned to apply a force directed along an axis extending through the center of mass of the microphone. More preferably, this axis passing through the center of mass of the microphone may also be aligned with a principal direction of movement of the microphone diaphragm. Further, the motion sensor(s) and actuator(s) may be located on a common axis that may pass through the center of mass of the microphone and/or be aligned with the principal direction of movement of the diaphragm. Further, where a plurality of actuators are employed, the actuators may be desirably positioned so that the centroid or combinative center of mass of such actuators is located on such a common axis.

In a related aspect, a method for attenuating undesired movement of an implantable microphone is provided. The method includes generating a motion signal that is indicative of movement of an implantable support member associated with an implantable microphone diaphragm. Preferably, the implantable support member is substantially isolated from outside sound such that the motion of the member is primarily caused by undesirable sources of vibration. In response to the motion signal, a force is applied at least in part to the support member to reduce relative movement between the microphone diaphragm and tissue overlying the microphone diaphragm. In this regard, the microphone diaphragm may be moved in response to the undesired motion to reduce or attenuate relative movement between the microphone diaphragm and overlying tissue. As will be appreciated, such relative movement may result in the application of forces to the diaphragm, which may be represented as undesired sound (e.g., noise). By reducing this relative movement, the output of an implanted microphone may be enhanced for hearing purposes.

In order to reduce the relative movement between the microphone diaphragm and the overlying tissue, it may be desirable to monitor the motion of the support member in a direction most likely to result in undesired relative movement. For instance, a planar diaphragm may have a primary direction of movement in a direction that is substantially normal to its planar surface. Accordingly, undesired movement in this direction may be more likely to result in undesired forced being applied to the diaphragm that may in turn be represented as undesirable sound. In this regard, a sensor operative to generate a motion signal in this direction may be utilized.

Further, to reduce relative movement, it may be desirable to apply a force aligned with the primary direction of movement of the microphone diaphragm. That is, by moving the microphone diaphragm primarily in the direction that is most likely to result in undesirable sound, more relative movement may be attenuated. Accordingly, more undesirable sound may be removed from an output of the microphone.

DETAILED DESCRIPTION OF THE INVENTION

Reference will now be made to the accompanying drawings, which at least assist in illustrating the various pertinent features of the present invention. In this regard, the following description of a hearing instrument is presented for purposes of illustration and description. Furthermore, the description is not intended to limit the invention to the form disclosed herein. Consequently, variations and modifications commensurate with the following teachings, and skill and knowledge of the relevant art, are within the scope of the present invention. The embodiments described herein are further intended to explain the best modes known of practicing the invention and to enable others skilled in the art to utilize the invention in such, or other embodiments and with various modifications required by the particular application(s) or use(s) of the present invention.

Figure 1:
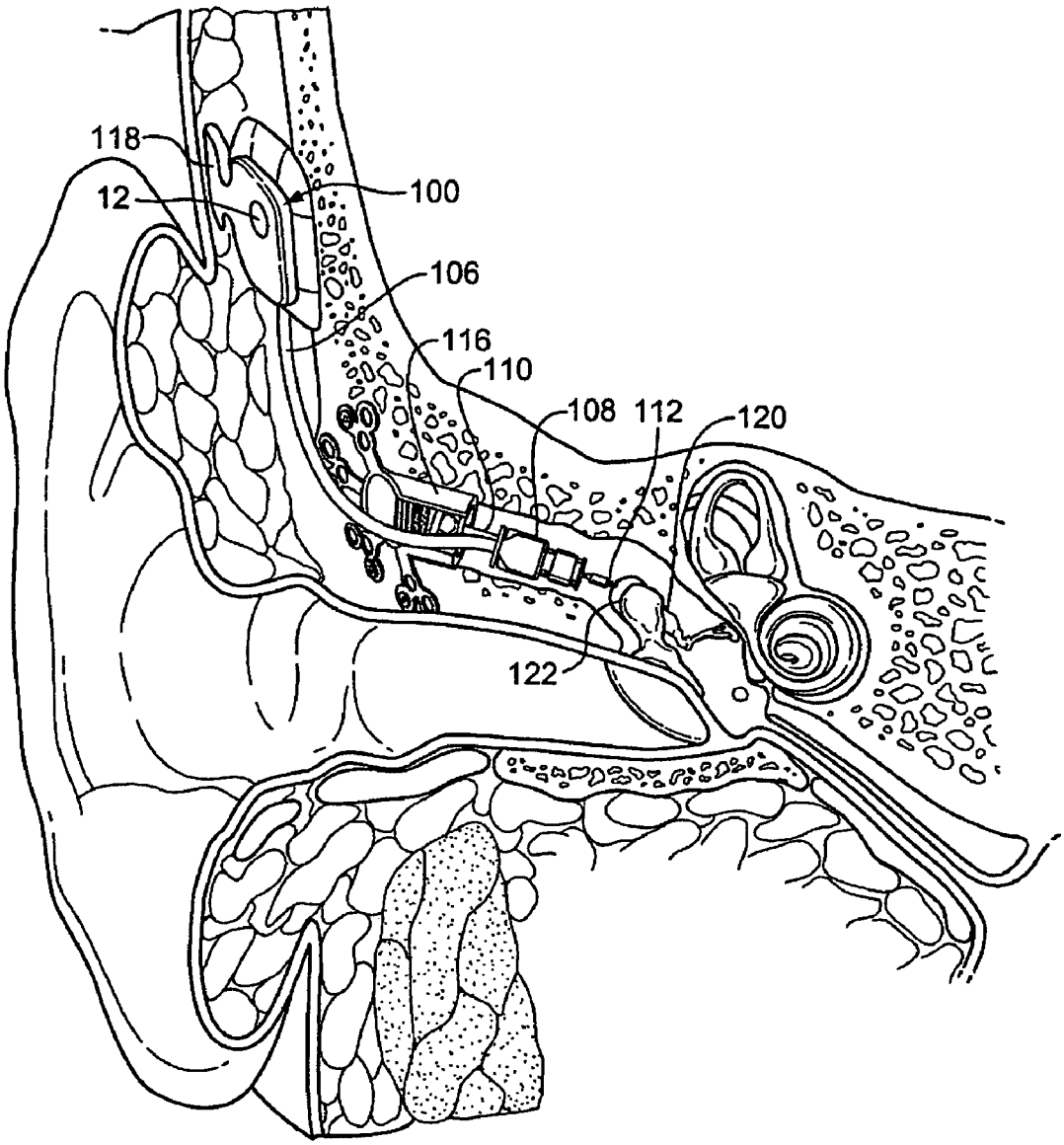
FIG. 1 illustrates a fully implantable hearing instrument as implanted in a wearer's skull.

Hearing Instrument System:

FIG. 1 illustrates one application of the present invention. As illustrated, the application comprises a fully implantable hearing instrument system. As will be appreciated, certain aspects of the present invention may be employed in conjunction with semi-implantable hearing instruments as well as fully implantable hearing instruments, and therefore the illustrated application is for purposes of illustration and not limitation.

In the illustrated system, a biocompatible implant capsule 100 is located subcutaneously on a patient's skull. The implant capsule 100 includes a signal receiver 118 (e.g., comprising a coil element) and a microphone diaphragm 12 that is positioned to receive acoustic signals through overlying tissue. The implant housing 100 may further be utilized to house a number of components of the fully implantable hearing instrument. For instance, the implant capsule 100 may house an energy storage device, a microphone transducer, and a signal processor. Various additional processing logic and/or circuitry components may also be included in the implant capsule 100 as a matter of design choice. Typically, a signal processor within the implant capsule 100 is electrically interconnected via wire 106 to a transducer 108.

The transducer 108 is supportably connected to a positioning system 110, which in turn, is connected to a bone anchor 116 mounted within the patient's mastoid process (e.g., via a hole drilled through the skull). The transducer 108 includes a connection apparatus 112 for connecting the transducer 108 to the ossicles 120 of the patient. In a connected state, the connection apparatus 112 provides a communication path for acoustic stimulation of the ossicles 120, e.g., through transmission of vibrations to the incus 122.

During normal operation, acoustic signals are received subcutaneously at the microphone diaphragm 12. Upon receipt of the acoustic signals, a signal processor within the implant capsule 100 processes the signals to provide a processed audio drive signal via wire 106 to the transducer 108. As will be appreciated, the signal processor may utilize digital processing techniques to provide frequency shaping, amplification, compression, and other signal conditioning, including conditioning based on patient-specific fitting parameters. The audio drive signal causes the transducer 108 to transmit vibrations at acoustic frequencies to the connection apparatus 112 to effect the desired sound sensation via mechanical stimulation of the incus 122 of the patient.

To power the fully implantable hearing instrument system of FIG. 1, an external charger (not shown) may be utilized to transcutaneously re-charge an energy storage device within the implant capsule 100. In this regard, the external charger may be configured for disposition behind the ear of the implant wearer in alignment with the implant capsule 100. The external charger and the implant capsule 100 may each include one or more magnets to facilitate retentive juxtaposed positioning. Such an external charger may include a power source and a transmitter that is operative to transcutaneously transmit, for example, RF signals to the signal receiver 118. In this regard, the signal receiver 118 may also include, for example, rectifying circuitry to convert a received signal into an electrical signal for use in charging the energy storage device. In addition to being operative to recharge the on-board energy storage device, such an external charger may also provide program instructions to the processor of the fully implantable hearing instrument system.

Figure 2:
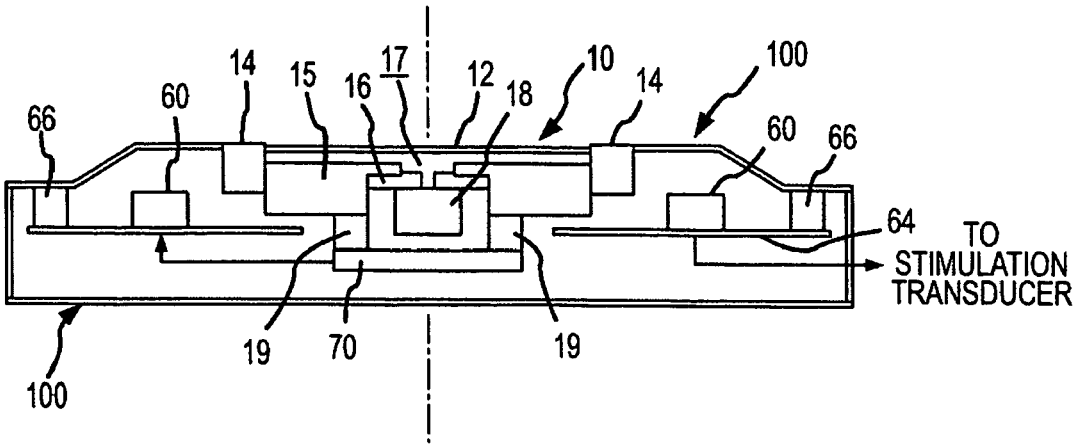
FIG. 2 is a schematic, cross-sectional illustration of one embodiment of the present invention.
Figure 3:
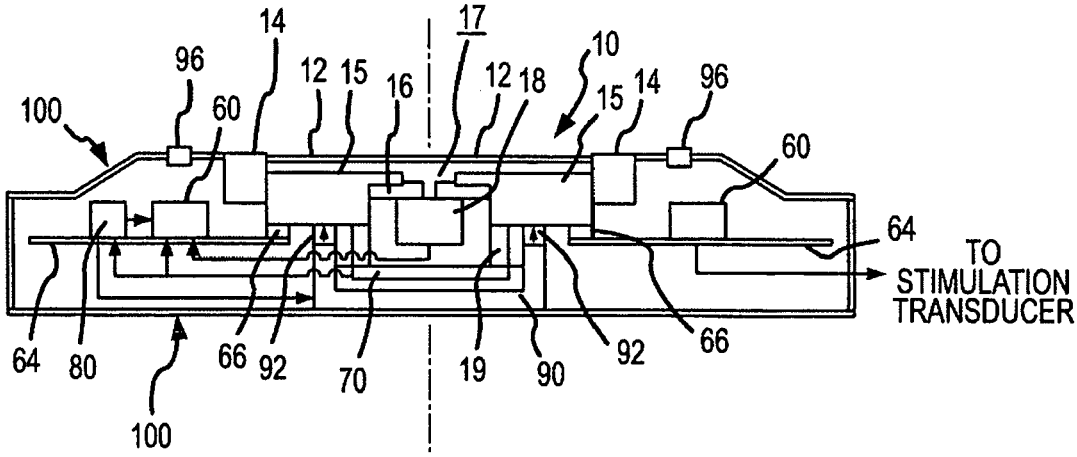
FIG. 3 is a schematic, cross-sectional illustration of another embodiment of the present invention.
Figure 4:
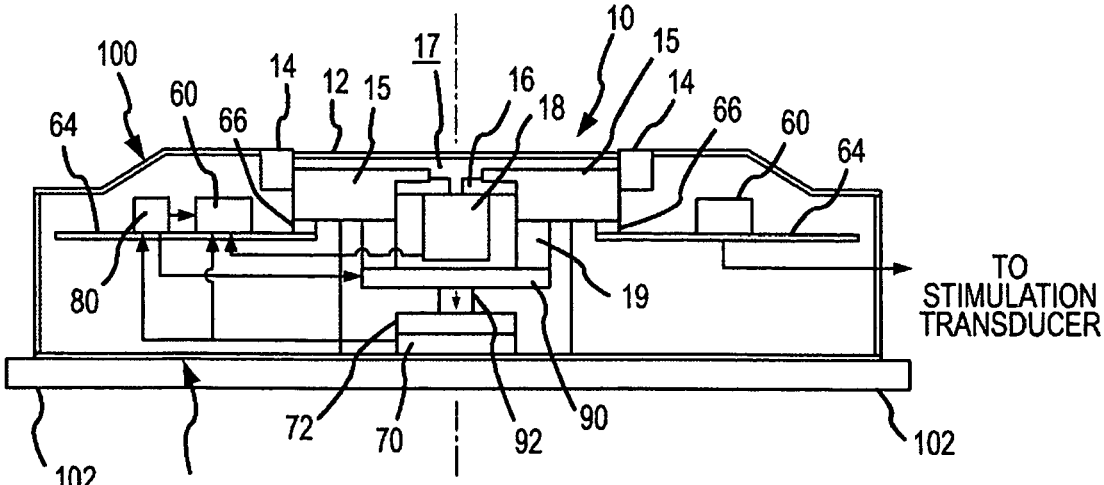
FIG. 4 is a schematic, cross-sectional illustration of yet another embodiment of the present invention.

Vibration Attenuation:

FIGS. 2, 3 and 4 show alternate embodiments of the present invention. In each embodiment a microphone assembly 10 is mounted within an opening of an implant capsule 100. The microphone assembly 10 includes an external diaphragm 12 (e.g., a titanium membrane) and a housing having a surrounding support member 14 and fixedly interconnected support members 15, 16, which combinatively define a chamber 17 behind the diaphragm 12. The microphone assembly 10 may further include a microphone transducer 18 that is supportably interconnected to support member 15 and interfaces with chamber 17, wherein the microphone transducer 18 provides an electrical output responsive to vibrations of the diaphragm 12. The microphone transducer 18 may be defined by any of a wide variety of electroacoustic transducers, including for example, capacitor arrangements (e.g., electret microphones) and electrodynamic arrangements.

One or more processor(s) and/or circuit component(s) 60 and an on-board energy storage device (not shown) may be supportably mounted to a circuit board 64 disposed within implant capsule 100. In the embodiment of FIG. 2, the circuit board is supportably interconnected via support(s) 66 to the implant capsule 100. In the embodiments of FIGS. 3 and 4 the circuit board 64 is supportably interconnected via support(s) 66 to the support member 15 of the microphone assembly 10. The processor(s) and/or circuit component(s) 60 may process the output signal of microphone transducer 18 to provide a drive signal to an implanted transducer. The processor(s) and/or circuit component(s) 60 may be electrically interconnected with an implanted, inductive coil assembly (not shown), wherein an external coil assembly (i.e., selectively locatable outside a patient body) may be inductively coupled with the inductive coil assembly to recharge the on-board energy storage device, to provide program instructions to the processor(s) 60, etc.

As may be appreciated, in the embodiments shown in FIGS. 2, 3 and 4, vibrations transmitted through a patient's skull will cause vibration of the implant capsule 100 and microphone assembly 10 relative to the skin that overlies the given embodiment. In this regard, the movement of the diaphragm 12 relative to the overlying skin may result in the exertion of a force on the diaphragm 12. The exerted force may cause undesired vibration of the diaphragm 12, which may be included in the electrical output of the transducer 18 as received sound. Forces aligned with the principal direction of movement of the diaphragm 12 are of particular interest for purposes of reducing undesired vibration. That is, forces exerted in this direction tend to result in a majority of undesired relative movement between the diaphragm 12 and overlying skin. As shown in FIGS. 2, 3 and 4, the diaphragm's principal direction of movement is substantially normal to the surface of the diaphragm 12. Therefore, in the embodiments of FIGS. 2, 3 and 4 vibrations transmitted through the patient's skull that cause movement in a direction normal to the surface of the diaphragm 12 are of primary concern.

To actively address such transmitted vibration and, hence, undesired vibration of the diaphragm 12, each of the embodiments includes a motion sensor 70 that provides an output signal proportional to the vibrational movement of the support member to which it is attached. In the FIG. 2 and FIG. 3 embodiments, the motion sensor 70 is supportably interconnected to the support member 15 of microphone assembly 10 via interconnect member(s) 19. In the FIG. 4 embodiment, the accelerometer 70 is directly mounted to a base portion of the implant capsule 100 and a proof mass 72 is interconnected thereto. As will be appreciated, motion sensor may include one or more directions or "axes" of motion sensitivity. In this regard, motion sensor may monitor motion in a single axis or in multiple axes (e.g., three axes).

In each of the arrangements, the motion sensor 70 may be located such that at least one axis of sensitivity of the motion sensor 70 is aligned with the principle direction of movement of the diaphragm 12. That is, at least one axis of sensitivity of the accelerometer 70 may be located such that it is sensitive to movement normal to the surface of the diaphragm 12. More preferably, this axis of sensitivity may also pass through a center of mass of the microphone assembly 10. In this regard, the movement of the microphone assembly 10 in the direction most likely to result in undesired vibration within the diaphragm 12 may be more accurately monitored. As may be appreciated, multiple motion sensor may be employed in the embodiments with corresponding analogous mounting arrangements to that shown for the motion sensor 70 in the given embodiment.

With particular respect to the embodiment of FIG. 2, the motion sensor output signal is provided to the processor(s) and/or circuit component(s) 60 for processing together with the output signal from microphone transducer 18. More particularly, the processor(s) and/or circuit component(s) 60 may scale and frequency-shape the motion sensor output of, for example, an accelerometer output signal to match a difference in the frequency response between such signal and the output signal of the microphone transducer 18. In turn, the scaled, frequency-shaped accelerometer output signal may be subtracted from the microphone transducer output signal to produce a net audio signal. Such net audio signal may then be further processed and output to an implanted stimulation transducer for stimulation of a middle ear component or cochlear implant. As may be appreciated, by virtue of the arrangement of the FIG. 2 embodiment, the net audio signal will reflect reduced vibration sensitivity.

Referring now to FIG. 3, the motion sensor output signal may be provided to a controller 80. In turn the controller 80 may provide a control signal to an actuator 90 (e.g., a piezo-electric actuator), wherein an actuator member 92 of the actuator 90 is provided to selectively impart forces against the support member 15 of microphone assembly so as to reduce the movement of the external diaphragm 12, relative to the skin of a patient that covers the external diaphragm 12. Further in this regard, the embodiment of FIG. 2 includes a compliant member 96 (e.g., comprising an elastomer material) interposed between the microphone assembly 10 and that portion of implant capsule 100 to which actuator 90 is interconnected. The compliant member 96 facilitates reduced vibration of the microphone assembly 10 in response to forces applied thereto by actuator member 92 while providing enhanced ability of the actuator to move that portion of the microphone including the diaphragm. As shown, the compliant member 96 surrounds the microphone assembly 10 and is interconnected at its inner and outer periphery to implant capsule 100. Numerous other arrangements are also possible, e.g., the compliant member may be interconnected between the support member 14 and implant capsule 100.

Referring now to FIG. 4, the motion sensor output signal may be provided to a controller 80 which in turn may provide a control signal to an actuator 90 (e.g., a piezo-electric actuator) that is interconnected to support member 15 of microphone assembly 10 via interconnect member(s) 19. The actuator 90 includes an actuator member 92 disposed to actively impart forces against the proof mass 72 interconnected to the motion sensor 70 so as to reduce movement of the implant capsule 100. In turn, movement of the microphone assembly 10, including external diaphragm 12, relative to the skin of the patient is reduced. In this embodiment, a compliant member 102 may be interposed between implant capsule 100 and the skull of a patient.

In each of the FIG. 3 and FIG. 4 arrangements, the controller 80 may be provided so that the actuator 90 selectively reduces undesired vibrations within a predetermined frequency range of concern (e.g., 100 Hz to 10 kHz). To enhance performance, the actuator 90 may be located to exert a force that is directed in the principle direction of movement of the diaphragm 12 (e.g., normal to the surface of the diaphragm 12). Furthermore, it may be desirable that the actuator exerts such a force along an axis that passes through the center of mass of the microphone assembly 10. As will be appreciated, by exerting a force aligned with an axis that passes substantially through the center of mass of the microphone assembly 10, movement of the microphone assembly 10 along that axis may be achieved while minimizing or eliminating rotation of the assembly about one or more orthogonal axes. Further, both the motion sensor 70 and actuator 90 may be located on a common axis that passes though the center of mass of the microphone assembly 10. Additionally, the various components mounted on circuit board 64 may be arranged so that their collective center of mass is substantially located on such a common axis passing through the center of mass of the of microphone assembly 10. Finally, multiple actuators may be employed in the embodiments of FIG. 3 and FIG. 4 with corresponding analogous mounting arrangements to that shown for actuator 90 in the given embodiment.

In the FIG. 3 and FIG. 4 embodiments, by virtue of the reduced movement of microphone assembly 10 relative to the overlying skin of a patient, the audio output signal provided by the processor(s) and/or circuit component(s) 60 (e.g., to an implanted transducer) will reflect reduced vibration sensitivity. In turn, stimulation of a middle ear transducer or cochlear implant may be enhanced.

As shown in FIGS. 3 and 4, the motion sensor 70 and/or controller 80 may also provide output signal(s) to the processor and/or circuit component(s) 60 for generation of an enhanced audio output signal in the manner described with reference to FIG. 2. That is, the FIG. 2 embodiment may be employed in combination with either of the FIG. 3 or FIG. 4 embodiments.

Those skilled in the art will appreciate variations of the above-described embodiments that fall within the scope of the invention. As a result, the invention is not limited to the specific examples and illustrations discussed above, but only by the following claims and their equivalents.

What is claimed:

1. A system for isolating an implantable hearing aid microphone from non-ambient vibrations, comprising:

an implant capsule for housing at least one hearing aid component subcutaneously;

a microphone supported relative to said capsule;

a motion sensor operative to generate a motion signal indicative of movement of said microphone; and an actuator operative to apply a force between said implant capsule and said microphone in response to said motion signal.

2. The system of claim 1, wherein said force applied by said actuator is operative to generate relative movement between said microphone and said implant capsule.

3. The system of claim 1, wherein said actuator is operative to generate said force in response to said motion signal being in a frequency range of about 100 Hz to about 10 kHz.

4. The system of claim 1, further comprising:

a compliant base member disposed on an outside surface of said implant capsule, wherein said compliant base member is adapted to be disposed between said implant capsule and an implant capsule mounting surface upon implantation.

5. The system of claim 1, wherein said motion sensor includes an axis of sensitivity passing through a center of mass of said microphone.

6. The system of claim 5, wherein said actuator is positioned to exert a force along said axis passing through said center of mass.

7. The system of claim 1, further comprising:

a processor operative to:

receive an output signal from said microphone and said motion signal; and remove at least a portion of said motion signal from said output signal to generate an audio signal, said audio signal being operative to actuate an actuator of a hearing instrument.

8. A method for attenuating vibration in an implantable hearing aid microphone, comprising the steps of:

generating a motion signal indicative of movement of an implantable support member associated with an implantable microphone diaphragm;

applying a force at least in part to said support member in response to said motion signal, said force being operative to reduce relative movement between said microphone diaphragm and tissue overlying said microphone diaphragm.

9. The method of claim 8, wherein said generating step comprises generating a signal indicative of non-acoustic vibration received by said microphone diaphragm.

10. The method of claim 8, wherein said applying step comprises applying a force between an implant capsule that at least in part supports said microphone diaphragm and said support member.

11. The method of claim 8, wherein said force is operative to move said microphone diaphragm relative to said support member.

12. The method of claim 8, wherein said force is operative to move said microphone diaphragm relative to overlying tissue.

13. The method of claim 8, wherein said force is applied along an axis that is substantially normal to a principal direction of movement of said diaphragm in response to acoustic stimulation.

14. The method of claim 8, wherein said microphone diaphragm, a transducer, and a microphone housing define a microphone assembly.

15. The method of claim 14, wherein said force is applied along an axis that extends though a center of mass of said microphone assembly.

16. The method of claim 15, wherein said force is applied along an axis that is substantially normal to a principal direction of movement of said diaphragm in response to acoustic stimulation.

17. The method of claim 14, wherein said generating step comprises generating a motion signal that is indicative of movement of said center of mass.

18. The method of claim 17, wherein generating step comprises generating a motion signal that is indicative of movement in a direction normal to a principal direction of movement of said diaphragm in response to acoustic stimulation.

* * * * *